US007514195B2

(12) United States Patent
Zwartz et al.

(10) Patent No.: US 7,514,195 B2
(45) **Date of Patent: *Apr. 7, 2009**

(54) TONER COMPOSITIONS

(75) Inventors: Edward G. Zwartz, Mississauga (CA); T. Brian McAneney, Burlington (CA); Daryl Vanbesien, Burlington (CA); Patricia A. Burns, Milton (CA); T. Hwee Ng, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 251 days.

This patent is subject to a terminal disclaimer.

(21) Appl. No.: 11/003,176

(22) Filed: Dec. 3, 2004

(65) Prior Publication Data

US 2006/0121383 A1 Jun. 8, 2006

(51) Int. Cl.
*G03G 9/00* (2006.01)

(52) U.S. Cl. ..... 430/109.1; 430/109.3; 430/109.4; 430/111.4; 430/137.14; 399/252

(58) Field of Classification Search ..... 430/109.1, 430/109.3, 109.4, 111.4, 137.14; 399/252
See application file for complete search history.

(56) References Cited

U.S. PATENT DOCUMENTS 3,674,736 A 7/1972 Lerman
4,291,111 A 9/1981 Lu
4,457,998 A * 7/1984 Gruber et al. ..... 430/98
5,290,654 A 3/1994 Sacripante
5,308,734 A 5/1994 Sacripante
5,344,738 A 9/1994 Kmiecik-Lawrynowi
5,346,797 A 9/1994 Kmiecik-Lawrynowi
5,348,832 A 9/1994 Sacripante
5,364,729 A 11/1994 Kmiecik-Lawrynowi
5,366,841 A 11/1994 Patel
5,370,963 A 12/1994 Patel
5,395,723 A * 3/1995 Mahabadi et al. ..... 430/137.1
5,403,693 A 4/1995 Patel
5,405,728 A 4/1995 Hopper
5,418,108 A 5/1995 Kmiecik-Lawrynowi
5,480,756 A * 1/1996 Mahabadi et al. ..... 430/109.1
5,496,676 A 3/1996 Croucher
5,501,935 A 3/1996 Patel
5,527,658 A 6/1996 Hopper
5,585,215 A 12/1996 Ong
5,650,255 A 7/1997 Ng
5,650,256 A 7/1997 Veregin
5,723,253 A 3/1998 Higashino
5,744,520 A 4/1998 Kmiecik-Lawrynowi
5,747,215 A 5/1998 Ong
5,763,133 A 6/1998 Ong
5,766,818 A 6/1998 Smith
5,804,349 A 9/1998 Ong
5,814,429 A * 9/1998 Kawakami et al. ..... 430/124
5,827,633 A 10/1998 Ong
5,840,462 A 11/1998 Foucher
5,853,944 A 12/1998 Foucher
5,863,698 A 1/1999 Patel
5,869,215 A 2/1999 Ong
5,869,216 A 2/1999 Ong
5,869,558 A 2/1999 Hou
5,902,710 A 5/1999 Ong
5,910,389 A 6/1999 Matsumura
5,916,725 A 6/1999 Patel
5,919,595 A 7/1999 Mychajlowskij
5,925,488 A 7/1999 Patel
5,928,830 A 7/1999 Cheng
6,130,021 A 10/2000 Patel
6,294,306 B1 9/2001 Kmiecik-Lawrynowi
6,309,787 B1 10/2001 Cheng
6,331,372 B1 * 12/2001 Livengood et al. ..... 430/108.8
6,413,692 B1 7/2002 Cheng
6,447,974 B1 9/2002 Chin
6,576,389 B2 6/2003 Vanbesien
6,617,092 B1 9/2003 Patel
6,627,373 B1 9/2003 Patel
6,638,677 B2 10/2003 Patel
6,656,657 B2 12/2003 Patel
6,656,658 B2 12/2003 Patel
6,664,017 B1 12/2003 Patel
6,673,505 B2 1/2004 Jiang
6,767,684 B1 * 7/2004 Patel et al. ..... 430/137.14
6,808,851 B2 * 10/2004 Bartel et al. ..... 430/108.1
6,924,073 B2 * 8/2005 Higuchi et al. ..... 430/108.4
6,936,396 B2 * 8/2005 Patel ..... 430/137.14
6,942,954 B2 * 9/2005 Patel et al. ..... 430/137.1

OTHER PUBLICATIONS

European Patent Office Communication dated Dec. 27, 2007, extended European Search Report, Application No. 05111689.5-1217, 7 pages.

* cited by examiner

*Primary Examiner*—Mark A Chapman
(74) *Attorney, Agent, or Firm*—Meryluu J. Lavoie, Esq. LLC

(57) ABSTRACT

Toner compositions provide a resin substantially free of cross linking; a cross linked resin; a wax; a coagulant; and a colorant; wherein the toner composition provides a fused image gloss of about 1 to about 20 gloss units.

18 Claims, No Drawings

TONER COMPOSITIONS

TECHNICAL FIELD

The present disclosure relates to toner compositions and more particularly relates to toner compositions and processes that for example, provide excellent printed image characteristics.

RELATED APPLICATIONS

Commonly assigned, co-pending U.S. Patent Application of Raj D. Patel, Daryl Vanbesien, Enno E. Agur, Edward G. Zwartz, Maria N. V. McDougall, Emily L. Moore, Patricia A. Burns, Kimberly D. Nosella, Ke Zhou, Vladislav Skorokhod, Wafa F. Bashir, and Shigang Steven Qui, Ser. No. 11/003,581, entitled "Toner Compositions," filed of even date herewith, which is hereby incorporated by reference herein in its entirety, describes toner compositions and processes, such as emulsion aggregation toner processes, for preparing toner compositions comprising a resin substantially free of cross linking; a cross linked resin; a wax; and a colorant.

Commonly assigned, co-pending U.S. Patent Application of Edward Graham Zwartz and T. Brian McAneney, Ser. No. 11/003,966, entitled "Toner Processes," filed of even date herewith, which is hereby incorporated by reference herein in its entirety, describes a process comprising developing an image on a document with a toner composition comprising a resin substantially free of cross linking, a cross linked resin, a wax, and a colorant; and wherein the developed document possesses the characteristic of being protected from or resistant to the adverse effects of electron beam irradiation.

Commonly assigned, co-pending U.S. Patent Application of Vladislav Skorokhod, Wafa Faisul Bashir, Maria N. V. McDougall, and Shigang Steven Qiu, Ser. No. 11/003,297, entitled "Toner Compositions," filed of even date herewith, which is hereby incorporated by reference herein in its entirety, describes a toner composition comprising a resin substantially free of cross linking; a cross linked resin; wax; and a conductive colorant.

Commonly assigned, co-pending U.S. Patent Application of Maria N. V. McDougall and Richard P. N. Veregin, Ser. No. 11/003,256, entitled "Toner Compositions" filed of even date herewith, which is hereby incorporated by reference herein in its entirety, describes a toner composition comprising a binder, colorant, and a charge control surface additive mixture comprising a mixture of a first titanium dioxide possessing a first conductivity and a second titanium dioxide possessing a second conductivity and which second conductivity is dissimilar from the first conductivity; wherein the mixture of the first titanium dioxide and the second titanium dioxide is selected in a ratio sufficient to impart a selected triboelectric charging characteristic to the toner composition.

The appropriate components and process aspects of each of the foregoing may be selected for the present disclosure in embodiments thereof.

BACKGROUND

For both black and color prints, a small particle size toner is known to improve the image quality of the prints. High speed black and white printers require toner particles that can provide a matte finish in an oil-less fuser system with a low minimum fixing temperature (MFT) to enable high speed printing and at the same time achieve superior image quality in the resultant printed product. Desired toner properties, particularly for high speed printing such as speeds of 150 pages per minute or 180 pages per minute, include a low minimum fixing temperature, wide fusing latitude, good release, low gloss, robust particles, and advantageous triboelectrical and development properties.

U.S. Pat. No. 6,447,974 describes in the Abstract a process for the preparation of a latex polymer by (i) preparing or providing a water aqueous phase containing an anionic surfactant in an optional amount of less than or equal to about 20 percent by weight of the total amount of anionic surfactant used in forming the latex polymer; (ii) preparing or providing a monomer emulsion in water which emulsion contains an anionic surfactant; (iii) adding about 50 percent or less of said monomer emulsion to said aqueous phase to thereby initiate seed polymerization and to form a seed polymer, said aqueous phase containing a free radical initiator; and (iv) adding the remaining percent of said monomer emulsion to the composition of (iii) and heating to complete an emulsion polymerization thus forming a latex polymer.

U.S. Pat. No. 6,413,692 describes in the Abstract a process comprising coalescing a plurality of latex encapsulated colorants and wherein each of said encapsulated colorants are generated by miniemulsion polymerization.

U.S. Pat. No. 6,309,787 describes in the Abstract thereof a process comprising aggregating a colorant encapsulated polymer particle containing a colorant with colorant particles and wherein said colorant encapsulated latex is generated by a miniemulsion polymerization.

U.S. Pat. No. 6,294,306 describes in the Abstract toners which include one or more copolymers combined with colorant particles or primary toner particles and a process for preparing a toner comprising (i) polymerizing an aqueous latex emulsion comprising one or more monomers, an optional nonionic surfactant, an optional anionic surfactant, an optional free radical initiator, an optional chain transfer agent, and one or more copolymers to form emulsion resin particles having the one or more copolymers dispersed therein; (ii) combining the emulsion resin particle with colorant to form statically bound aggregated composite particles; (iii) heating the statically bound aggregated composite particles to form toner; and (iv) optionally isolating the toner.

U.S. Pat. No. 6,130,021 describes in the Abstract a process involving the mixing of a latex emulsion containing resin and a surfactant with a colorant dispersion containing a nonionic surfactant, and a polymeric additive and adjusting the resulting mixture pH to less than about 4 by the addition of an acid and thereafter heating at a temperature below about, or equal to about the glass transition temperature (Tg) of the latex resin, subsequently heating at a temperature above about, or about equal to the Tg of the latex resin, cooling to about room temperature, and isolating the toner product.

U.S. Pat. No. 5,928,830 describes in the Abstract a process for the preparation of a latex comprising a core polymer and a shell there over and wherein the core polymer is generated by (A) (i) emulsification and heating of the polymerization reagents of monomer, chain transfer agent, water, surfactant, and initiator; (ii) generating a seed latex by the aqueous emulsion polymerization of a mixture comprised of part of the (i) monomer emulsion, from about 0.5 to about 50 percent by weight, and a free radical initiator, and which polymerization is accomplished by heating, and, wherein the reaction of the free radical initiator and monomer produces a seed latex containing a polymer; (iii) heating and adding to the formed seed particles of (ii) the remaining monomer emulsion of (I), from about 50 to about 99.5 percent by weight of monomer emulsion of (i) and free radical initiator; (iv) whereby there is provided said core polymer; and (B) forming a shell there over said core generated polymer and which shell is generated by emulsion polymerization of a second monomer in the presence of the core polymer, which emulsion polymerization is accomplished by (i) emulsification and heating of the polymerization reagents of monomer, chain transfer agent, surfactant, and an initiator; (ii) adding a free radical initiator and heating; (iii) whereby there is provided said shell polymer.

U.S. Pat. No. 5,869,558 describes in the Abstract dielectric black particles for use in electrophoretic image displays, electrostatic toner or the like, and the corresponding method of manufacturing the same. The black particles are latex particles formed by a polymerization technique, wherein the latex particles are stained to a high degree of blackness with a metal oxide.

U.S. Pat. No. 5,869,216 describes in the Abstract a process for the preparation of toner comprising blending an aqueous colorant dispersion and a latex emulsion containing resin; heating the resulting mixture at a temperature below about the glass transition temperature (Tg) of the latex resin to form toner sized aggregates; heating said resulting aggregates at a temperature above about the Tg of the latex resin to effect fusion or coalescence of the aggregates; redispersing said toner in water at a pH of above about 7; contacting the resulting mixture with a metal halide or salt, and then with a mixture of an alkaline base and a salicylic acid, a catechol, or mixtures thereof at a temperature of from about 25 degrees C. to about 80 degrees C.; and optionally isolating the toner product, washing, and drying.

U.S. Pat. No. 6,576,389 describes in the Abstract a process for the preparation of toner by, for example, mixing a colorant, a latex, a wax and a dual coagulant mixture comprising water solubilized silica with an alumina coating referred to as aluminized silica and a polyaluminum chloride to provide, for example, a toner composition of different gloss levels when fused. Additional patents of interest include U.S. Pat. No. 5,766,818; U.S. Pat. No. 5,344,738; and U.S. Pat. No. 4,291,111.

U.S. Pat. No. 5,650,256 describes in the Abstract a process for the preparation of toner comprising: (i) preparing a pigment dispersion, which dispersion is comprised of a pigment, and an ionic surfactant; (ii) shearing said pigment dispersion with a latex or emulsion blend comprised of resin, a counterionic surfactant with a charge polarity of opposite sign to that of said ionic surfactant and a nonionic surfactant, and wherein said resin contains an acid functionality; (iii) heating the above sheared blend below about the glass transition temperature (Tg) of the resin to form electrostatically bound toner size aggregates; (iv) adding anionic surfactant to stabilize the aggregates obtained in (iii); (v) coalescing said aggregates by heating said bound aggregates above about the Tg of the resin; (vi) reacting said resin of (v) with acid functionality with a base to form an acrylic acid salt, and which salt is ion exchanged in water with a base or a salt, optionally in the presence of metal oxide particles, to control the toner triboelectrical charge, which toner is comprised of resin and pigment; and (vii) optionally drying the toner obtained.

The disclosures of each of the foregoing U.S. Patents are totally incorporated herein by reference in their entireties. The appropriate components and process aspects of each of the foregoing U.S. Patents may be selected for the present disclosure in embodiments thereof There remains a need for an improved toner composition and process which overcomes or alleviates the above described and other problems. There further remains a need for toner compositions suitable for high speed printing, particularly high speed monochrome printing, that can provide improved image characteristics such as excellent fusing performance properties such as fused image gloss, release properties, hot offset characteristics, minimum fixing temperature, and small toner particle size characteristics.

SUMMARY

A toner composition is described comprising a resin substantially free of cross linking; a cross linked resin; a wax; a coagulant; and a colorant; wherein the toner composition possesses a fused image gloss in embodiments of about 1 to about 20 gloss units, less than about 20 gloss units, or about 9 to about 14 gloss units. A resin that is substantially free of cross linking (also referred to herein as a non cross linked resin) refers for example, to an uncrosslinked resin, a resin having substantially about zero percent cross linking to about 0.2 percent cross linking or a resin having less than about 0.1 percent cross linking; and a cross linked resin refers for example, to a cross linked resin or gel comprising, for example, about 0.3 to about 20 percent cross linking.

A toner process for preparing a toner is described comprising mixing a resin substantially free of cross linking and a cross linked resin in the presence of a wax, a colorant, and a coagulant to provide toner size aggregates; adding additional resin substantially free of cross linking to the formed aggregates thereby providing a shell over the formed aggregates; heating the shell covered aggregates to form toner; and optionally, isolating the toner; wherein the toner composition provides a fused image gloss of about 1 to about 20 gloss units, less than about 20 gloss units, or about 9 to about 14 gloss units. The shell has, for example, a shell thickness of about 0.3 to about 0.8 micrometers. In embodiments, the heating comprises a first heating below the glass transition temperature of the resin substantially free of cross linking and a second heating above the glass transition temperature of the resin substantially free of cross linking.

A developer is described comprising a toner composition comprising a non cross linked resin; a cross linked resin; a wax; a coagulant; and a colorant; wherein the toner composition provides for example a suitable fused image gloss in embodiments of about 1 to about 20 gloss units, less than about 20 gloss units, or about 9 to about 14 gloss units; and a carrier.

It is a feature of the present disclosure to provide a toner composition and process with many of the advantages illustrated herein. It is another feature of the present disclosure to provide a toner composition and process, such as a black chemical toner composition and process, having a fusing performance including excellent gloss properties, crease, stripper finger marks, document and vinyl offset properties, which in combination provide an optimum fusing latitude. It is another feature of the present disclosure to provide a toner composition suitable for use in high speed applications, particularly for use in high speed black and white printers and color printers. It is another feature of the disclosure to provide a toner composition and process providing a matte finish in oil-less fuser systems and having a low minimum fixing temperature to enable high speed printing. It is another feature of the disclosure to provide a toner composition and process for achieving selective gloss, release, hot offset, minimum fixing temperature, and desired toner particle size. It is a further feature of the disclosure to provide a black emulsion aggregation toner composition and process providing the above-mentioned and other features and advantages.

Aspects described herein further comprise, for example, a xerographic device comprising a charging component, an imaging component, a photoconductive component, a developing component, a transfer component, and a fusing component, and wherein the development component comprises the present developer. In further embodiments, devices comprising high speed printers, black and white high speed printers, color printers, or combinations thereof, are provided.

These and other features and advantages will be more fully understood from the following description of certain specific embodiments of the disclosure taken together with the accompanying drawings.

DESCRIPTION

A toner composition and toner process comprising a non cross linked resin; a cross linked resin or gel; a wax; a coagulant; and a colorant are described wherein the toner composition provides advantageous fusing properties, particularly advantageous fusing properties for high speed machines such as machines running at printing speeds of about, for example, 150 pages per minute and above. Aspects further relate to an emulsion aggregation toner, such as an emulsion aggregation black toner, for meeting machine requirements such as, for example, minimum fixing temperature, wide fusing latitude, release properties, low gloss, robust particles, triboelectrical and development properties, among others.

In embodiments, a toner composition and process provide a toner having a fused image gloss of about 1 to about 20 gloss units; a fused image gloss of less than about 20 gloss units, or a fused image gloss of about 9 to about 14 gloss units; a transmission optical density of at least about 1.60; a toner composition and process that provide a toner having a mass per unit area of about 0.52 mg/cm$^3$ or higher; a toner composition and an emulsion aggregation toner such as, for example, a toner composition and process providing an emulsion aggregation toner possessing a stripper finger mark characteristic that is superior to a conventional toner stripper finger mark characteristic; and a toner composition that possesses essentially zero observable stripper finger mark damage under ambient office lighting conditions.

In further embodiments, a toner composition and process provide a toner providing a minimum fixing temperature, such as a temperature that is about 10° C. lower than a minimum fixing temperature provided by conventional toner; a toner composition comprising for example about 68% to about 75% resin substantially free of cross linking, about 6% to about 13% cross linked resin or about 5% to about 10% cross linked resin, about 6% to about 15% wax, and about 7% to about 13% colorant, by weight based upon the total weight of the composition and wherein the total of the components is about 100 percent; a black toner, such as an emulsion aggregation toner, comprising about 5% to about 10% cross linked resin; a toner composition wherein at least one of the resin substantially free of cross linking and the cross linked resin comprises carboxylic acid in an amount of about 0.05 to about 10 weight percent based upon the total weight of the resin substantially free of cross linking or cross linked resin; a toner composition and toner process comprising a toner, for example an emulsion aggregation toner, having a colorant loading, such as a pigment loading, wherein the conductive colorant is present in an amount of about 4% to about 18%, or about 6% to about 10%, or about 10%, by weight based upon the total weight of the toner composition and wherein a total of the components is about 100%.

In further embodiments, a toner composition and process provide a print gloss of about 1 Gardner gloss units (ggu) to about 20 ggu, or less than about 20 ggu, or about 9 to about 14 ggu, at 75° C., as measured on a gloss meter, such as available from BYK-Gardner; a document offset range of slight damage to substantially no damage such as a document offset of about 3 to about 5 using a document offset evaluation rating procedure comprising an observation scale of 1 to 5, wherein a rating of 1 means that severe document offset damage is observed and a rating of 5 means an excellent document offset characteristic (that is, no observable offset); a vinyl offset comprising small amounts of toner offset to the vinyl to substantially no damage such as a document vinyl offset of about 4 to about 5 using a vinyl offset evaluation rating procedure wherein Grades 5.0 to 1.0 indicate progressively higher amounts of toner offset onto the vinyl, from slight (5) to severe (1); minimal or essentially zero observable stripper finger marks under normal ambient office lighting conditions or very light or short scratch marks that are difficult to observe under normal office lighting conditions to a visually observable change in gloss on the surface only at certain lighting angles; a transmission optical density of greater than or equal to about 1.6 with the lowest toner mass per unit area (TMA), such as for example about 0.54 to about 0.58 mg/cm$^2$ TMA, and combinations of the aforementioned characteristics.

Latex Resins or Polymers

Illustrative examples of latex resins or polymers selected for the non cross linked resin and cross linked resin or gel include, but are not limited to, styrene acrylates, styrene methacrylates, butadienes, isoprene, acrylonitrile, acrylic acid, methacrylic acid, beta-carboxy ethyl acrylate, polyesters, known polymers such as poly(styrene-butadiene), poly(methyl styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methyl styrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butyl acrylate-acrylic acid), poly(styrene-butyl acrylate-methacrylic acid), poly(styrene-butyl acrylate-acrylonitrile), poly(styrene-butyl acrylate-acrylonitrile-acrylic acid), and the like. In embodiments, the resin or polymer is a styrene/butyl acrylate/carboxylic acid terpolymer. In embodiments, at least one of the resin substantially free of cross linking and the cross linked resin comprises carboxylic acid in an amount of about 0.05 to about 10 weight percent based upon the total weight of the resin substantially free of cross linking or cross linked resin.

Non Cross Linked Resin

In embodiments, the resin that is substantially free of cross linking (also referred to herein as a non cross linked resin) comprises an uncrosslinked resin, a resin having substantially about zero percent cross linking to about 0.2 percent cross linking or less than about 0.1 percent cross linking. For example, the non cross linked latex comprises in embodiments monomers A, B, and C, prepared, for example, by emulsion polymerization in the presence of an initiator, a chain transfer agent (CTA), and surfactant and more specifically, for example styrene, butylacrylate, and beta-carboxy ethyl acrylate (beta-CEA) representing monomers A, B, and C, respectively, although not limited to these monomers.

In embodiments, the non cross linked resin monomers are present in an amount of about 70% to about 90% monomer A, about 10% to about 30% monomer B, and about 0.05 parts per hundred to about 10 parts per hundred monomer C, by weight based upon the total weight of the monomers although not limited, and more specifically, for example, about 70% to about 90% styrene, about 10% to about 30% butylacrylate, and about 0.05 parts per hundred to about 10 parts per hundred beta-CEA, or about 3 parts per hundred beta-CEA, by weight based upon the total weight of the monomers although not limited. For example, the carboxylic acid can be selected, for example, from the group comprised of, but not limited to, acrylic acid, methacrylic acid, itaconic acid, beta carboxy ethyl acrylate (beta CEA), fumaric acid, maleic acid, and cinnamic acid.

In a feature herein, the non cross linked resin comprises about 73% to about 85% styrene, about 27% to about 15% butylacrylate, and about 1.0 part per hundred to about 5 parts per hundred beta-CEA, by weight based upon the total weight of the monomers although the compositions and processes are not limited to these particular types of monomers or ranges. In another feature, the non cross linked resin comprises about 81.7% styrene, about 18.3% butylacrylate and about 3.0 parts per hundred beta-CEA by weight based upon the total weight of the monomers.

The polymerization initiator may be, for example, but is not limited to, sodium, potassium or ammonium persulfate and may be present in the range of, for example, about 0.5 to about 3.0 percent based upon the weight of the monomers, although not limited. The CTA may be present in an amount of from about 0.5 to about 5.0 percent by weight based upon the combined weight of the monomers A and B, although not limited. In embodiments, the surfactant is an anionic surfactant present in the range of about 0.7 to about 5.0 percent by weight based upon the weight of the aqueous phase, although not limited to this type or range.

For example, the monomers are polymerized under starve fed conditions as referred to in Xerox patents such as U.S. Pat. No. 6,447,974, U.S. Pat. No. 6,576,389, U.S. Pat. No. 6,617,092, and U.S. Pat. No. 6,664,017, which are hereby incorporated by reference herein in their entireties, to provide latex resin particles having a diameter in the range of about 100 to about 300 nanometers.

For example, the molecular weight of the non cross linked latex resin is from about 30,000 to about 37,000, preferably about 34,000, although not limited to this range. In embodiments, the onset glass transition temperature (TG) of the non cross linked resin is in the range of, for example, from about 46° C. to about 62° C., or about 58° C., although not limited; the amount of carboxylic acid groups is selected in the range of about 0.04 to about 4.0 pph of the resin monomers A and B, although not limited; the molecular number (Mn) is from about 5,000 to about 20,000, or about 11,000; and the prepared non cross linked latex resin has a pH of about 1.0 to about 4.0, or about 2.0, although not limited.

Cross Linked Resin or Gel

For example, a cross linked latex is prepared from monomers A, B, C, and D, by emulsion polymerization, in the presence of an initiator such as a persulfate, a chain transfer agent (CTA), and surfactant, and more specifically a non cross linked latex is prepared comprising styrene, butylacrylate, beta-CEA, and divinyl benzene representing monomers A, B, C, and D, respectively. In embodiments, the cross linked resin monomers are generally present in a ratio of about 60% to about 75% monomer A, about 40% to about 25% monomer B, about 40% to about 25% monomer C, and about 3 parts per hundred to about 5 parts per hundred monomer D; for example, for a specific resin, about 60% to about 75% styrene, about 40% to about 25% butylacrylate, about 3 parts per hundred to about 5 parts per hundred beta-CEA, and about 3 parts per hundred to about 5 parts per hundred divinyl benzene, although not limited to these particular types of monomers or ranges. In embodiments, the monomer composition may comprise, for example, about 65% styrene, about 35% butylacrylate, about 3 parts per hundred beta-CEA, and about 1 part per hundred divinyl benzene, although the composition is not limited to these amounts.

In embodiments, the Tg (onset) of the cross linked latex is about 40° C. to about 55° C. or about 42° C.; the degree of cross linking is in the range of about 0.3 to about 20 percent, although not limited thereto, since an increase in the divinyl benzene concentration will increase the cross linking; the soluble portion of the cross linked latex has a molecular weight (Mw) of about 135,000 and a molecular number (Mn) of about 27,000, but is not limited thereto; the particle diameter size of the cross linked latex is about 20 to about 250 nanometers or about 50 nanometers, although not limited; the pH is about 1.5 to about 3.0 or about 1.8; and the latex particle size can be, for example, from about 0.05 micron to about 1 micron in average volume diameter as measured by the Brookhaven nanosize particle analyzer. Other sizes and effective amounts of latex particles may be selected in embodiments.

The latex resins selected for the present process are prepared, for example, by emulsion polymerization methods, and the monomers utilized in such processes preferably include the monomers listed above, such as, styrene, acrylates, methacrylates, butadiene, isoprene, acrylonitrile, acrylic acid, and methacrylic acid, and beta carboxy ethyl acrylate. Known chain transfer agents, for example dodecanethiol, in effective amounts of, for example, from about 0.1 to about 10 percent, and/or carbon tetrabromide in effective amounts of from about 0.1 to about 10 percent, can also be employed to control the resin molecular weight during the polymerization.

Other processes of obtaining resin particles of from, for example, about 0.05 micron to about 1 micron can be selected from polymer microsuspension process, such as the processes disclosed in U.S. Pat. No. 3,674,736, the disclosure of which is totally incorporated herein by reference, polymer solution microsuspension processes, such as disclosed in U.S. Pat. No. 5,290,654, the disclosure of which is totally incorporated herein by reference, mechanical grinding processes, or other known processes.

Surfactants

The surfactant may be any surfactant, such as for example a nonionic surfactant or an anionic surfactant, such as Neogen RK™ (sodium dodecylbenzene sulfonate anionic emulsifier) or Dowfax™ (hexa decyldiphenyloxide disulfonate), both commercially available. For example, surfactants are selected in amounts of, for example, about 0.01 to about 20, or about 0.1 to about 15 weight percent of the reaction mixture in embodiments include, for example, nonionic surfactants such as dialkylphenoxypoly(ethyleneoxy) ethanol, available from Rhone-Poulenc as IGEPAL CA-210.™., IGEPAL CA-520.™., IGEPAL CA-720.™., IGEPAL CO-890.™., IGEPAL CO-720.™., IGEPAL CO-290.™., IGEPAL CA-210.™., ANTAROX 890.™. and ANTAROX 897.™ For example, an effective concentration of the nonionic surfactant is in embodiments, for example, about 0.01 to about 10 percent by weight, or about 0.1 to about 5 percent by weight of the reaction mixture.

In embodiments, the process comprises providing an anionic surfactant in an amount of about 0.01% to about 20% by weight based upon a total weight of the reaction mixture; wherein the anionic surfactant is selected from the group consisting of sodium dodecylsulfate, sodium dodecylbenzene sulfonate, sodium dodecylnaphthalene sulfate, dialkyl benzenealkyl, sulfates, sulfonates, adipic acid, hexa decyldiphenyloxide disulfonate, or mixtures thereof. Examples of anionic surfactants being, for example, sodium dodecylsulfate (SDS), sodium dodecylbenzene sulfonate, sodium dodecylnaphthalene sulfate, dialkyl benzenealkyl, sulfates and sulfonates, adipic acid, available from Aldrich, NEOGEN R.™., NEOGEN SC.™, available from Kao, Dowfax™ 2A1 (hexa decyldiphenyloxide disulfonate) and the like, among others. For example, an effective concentration of the anionic surfactant generally employed is, for example, about 0.01 to about 10 percent by weight, or about 0.1 to about 5 percent by weight of the reaction mixture Examples of bases used to increase the pH and hence ionize the aggregate particles thereby providing stability and preventing the aggregates from growing in size can be selected from sodium hydroxide, potassium hydroxide, ammonium hydroxide, cesium hydroxide and the like, among others.

Examples of additional surfactants, which may be added optionally to the aggregate suspension prior to or during the coalescence to, for example, prevent the aggregates from growing in size, or for stabilizing the aggregate size, with increasing temperature can be selected from anionic surfactants such as sodium dodecylbenzene sulfonate, sodium dodecylnaphthalene sulfate, dialkyl benzenealkyl, sulfates and sulfonates, adipic acid, available from Aldrich, NEOGEN R.™, NEOGEN SC™ available from Kao, and the like, among others. These surfactants can also be selected from nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhone-Poulenc as IGEPAL CA-210.™., IGEPAL CA-520.™., IGEPAL CA-72.™., IGEPAL CO-890.™., IGEPAL CO-720.™., IGEPAL CO-290.™., IGEPAL CA-210.™., ANTAROX 890.™. and ANTAROX 897.™. For example, an effective amount of the anionic or nonionic surfactant generally employed as an aggregate size stabilization agent is, for example, about 0.01 to about 10 percent or about 0.1 to about 5 percent, by weight of the reaction mixture.

Examples of the acids that can be utilized include, for example, nitric acid, sulfuric acid, hydrochloric acid, acetic acid, citric acid, trifluro acetic acid, succinic acid, salicylic acid and the like, and which acids are in embodiments utilized in a diluted form in the range of about 0.5 to about 10 weight percent by weight of water or in the range of about 0.7 to about 5 weight percent of water.

Wax

For example, wax suitable for the present toner compositions include, but are not limited to, alkylene waxes having about 1 to about 25 carbon atoms including, for example, polyethylene, polypropylene or mixtures thereof. The wax is present, for example, in an amount of about 6% to about 15% or about 6% to about 10% by weight based upon the total weight of the composition. Examples of waxes include those as illustrated herein, such as those of the aforementioned co-pending applications, polypropylenes and polyethylenes commercially available from Allied Chemical and Petrolite Corporation, wax emulsions available from Michaelman Inc. and the Daniels Products Company, Epolene N-15™ commercially available from Eastman Chemical Products, Inc., Viscol 550-P™, a low weight average molecular weight polypropylene available from Sanyo Kasei K. K., and similar materials. The commercially available polyethylenes possess, it is believed, a molecular weight (Mw) of about 1,000 to about 5,000, and the commercially available polypropylenes are believed to possess a molecular weight of about 4,000 to about 10,000. Examples of functionalized waxes include amines, amides, for example Aqua Superslip 6550™, Superslip 6530™ available from Micro Powder Inc., fluorinated waxes, for example Polyfluo 190™, Polyfluo 200™, Polyfluo 523XF™, Aqua Polyfluo 411™, Aqua Polysilk 19™, Polysilk 14™ available from Micro Powder Inc., mixed fluorinated, amide waxes, for example Microspersion 19™ also available from Micro Powder Inc., imides, esters, quaternary amines, carboxylic acids or acrylic polymer emulsion, for example Joncryl 74™, 89™, 130™, 537™, and 538™, all available from SC Johnson Wax, chlorinated polypropylenes and polyethylenes available from Allied Chemical and Petrolite Corporation and SC Johnson Wax.

In embodiments, the wax comprises a wax dispersion comprising, for example, a wax having a particle diameter of about 100 to about 500 nanometers, water, and an anionic surfactant. In embodiments, the wax is included in amounts such as about 6 to about 15 weight percent. In embodiments, the wax comprises polyethylene wax particles, such as Polywax® 850, commercially available from Baker Petrolite, having a volume average particle diameter in the range of about 100 to about 500 nanometers, although not limited. The surfactant used to disperse the wax is an anionic surfactant, although not limited thereto, such as, for example, Neogen RK™ commercially available from Kao Corporation.

Pigment/Colorant

Colorants include pigments, dyes, mixtures of pigments and dyes, mixtures of pigments, mixtures of dyes, and the like. In embodiments, the colorant comprises a pigment, a dye, mixtures thereof, carbon black, magnetite, black, cyan, magenta, yellow, red, green, blue, brown, mixtures thereof, selected for example, in an amount of about 1% to about 25% by weight based upon the total weight of the composition. It is to be understood that other useful colorants will become readily apparent to one of skill in the art based on the present disclosure.

In general, useful colorants or pigments in addition to carbon black include magnetite, or mixtures thereof; cyan, yellow magenta, or mixtures thereof, or red, green, blue, brown, or mixtures thereof Colorants that may be used include, but are not limited to, Paliogen Violet 5100 and 5890 (BASF), Normandy Magenta RD-2400 (Paul Ulrich), Permanent Violet VT2645 (Paul Ulrich), Heliogen Green L8730 (BASF), Argyle Green XP-111-S (Paul Ulrich), Brilliant Green Toner GR 0991 (Paul Ulrich), Lithol Scarlet D3700 (BASF), Toluidine Red (Aldrich), Scarlet for Thermoplast NSD Red (Aldrich), Lithol Rubine Toner (Paul Ulrich), Lithol Scarlet 4440, NBD 3700 (BASF), Bon Red C (Dominion Color), Royal Brilliant Red RD-8192 (Paul Ulrich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G10 (American Hoechst), Irgalite Blue BCA (Ciba Geigy), Paliogen Blue 6470 (BASF), Sudan II, II and IV (Matheson, Coleman, Bell), Sudan Orange (Aldrich), Sudan Orange 220 (BASF), Paliogen Orange 3040 (BASF), Ortho Orange OR 2673 (Paul Ulrich), Paliogen Yellow 152 and 1560 (BASF), Lithol Fast Yellow 0991K (BASF), Paliotol Yellow 1840 (BASF), Novaperm Yellow FGL (Hoechst), Permanerit Yellow YE 0305 (Paul Ulrich), Lumogen Yellow D0790 (BASF), Suco-Gelb 1250 (BASF), Suco-Yellow D1355 (BASF), Suco Fast Yellow D1165, D1355 and D1351 (BASF), Hostaperm Pink E (Hoechst), Fanal Pink D4830

(BASF), Cinquasia Magenta (DuPont), Paliogen Black L9984 9BASF), Pigment Black K801 (BASF) and particularly carbon blacks such as REGAL® 330 (Cabot), Carbon Black 5250 and 5750 (Columbian Chemicals), and the like or mixtures thereof Additional useful colorants include pigments in water based dispersions such as those commercially available from Sun Chemical, for example SUNSPERSE BHD 6011X (Blue 15 Type), SUNSPERSE BHD 9312X (Pigment Blue 15 74160), SUNSPERSE BHD 6000X (Pigment Blue 15:3 74160), SUNSPERSE GHD 9600X and GHD 6004X (Pigment Green 7 74260), SUNSPERSE QHD 6040X (Pigment Red 122 73915), SUNSPERSE RHD 9668X (Pigment Red 185 12516), SUNSPERSE RHD 9365X and 9504X (Pigment Red 57 15850:1, SUNSPERSE YHD 6005X (Pigment Yellow 83 21108), FLEXIVERSE YFD 4249 (Pigment Yellow 17 21105), SUNSPERSE YHD 6020X and 6045X (Pigment Yellow 74 11741), SUNSPERSE YHD 600X and 9604X (Pigment Yellow 14 21095), FLEXIVERSE LFD 4343 and LFD 9736 (Pigment Black 7 77226) and the like or mixtures thereof. Other useful water based colorant dispersions include those commercially available from Clariant, for example, HOSTAFINE Yellow GR, HOSTAFINE Black T and Black TS, HOSTAFINE Blue B2G, HOSTAFINE Rubine F6B and magenta dry pigment such as Toner Magenta 6BVP2213 and Toner Magenta EO2 which can be dispersed in water and/or surfactant prior to use.

Other useful colorants include, for example, magnetites, such as Mobay magnetites MO8029, MO8960; Columbian magnetites, MAPICO BLACKS and surface treated magnetites; Pfizer magnetites CB4799, CB5300, CB5600, MCX6369; Bayer magnetites, BAYFERROX 8600, 8610; Northern Pigments magnetites, NP-604, NP-608; Magnox magnetites TMB-100 or TMB-104; and the like or mixtures thereof Specific additional examples of pigments include phthalocyanine HELIOGEN BLUE L6900, D6840, D7080, D7020, PYLAM OIL BLUE, PYLAM OIL YELLOW, PIGMENT BLUE 1 available from Paul Ulrich & Company, Inc., PIGMENT VIOLET 1, PIGMENT RED 48, LEMON CHROME YELLOW DCC 1026, E.D. TOLUIDINE RED and BON RED C available from Dominion Color Corporation, Ltd., Toronto, Ontario, NOVAPERM YELLOW FGL, HOSTAPERM PINK E from Hoechst, and CINQUASIA MAGENTA available from E.I. DuPont de Nemours & Company, and the like. Examples of magentas include, for example, 2,9-dimethyl substituted quinacridone and anthraquinone dye identified in the Color Index as CI 60710, CI Dispersed Red 15, diazo dye identified in the Color Index as CI 26050, CI Solvent Red 19, and the like or mixtures thereof Illustrative examples of cyans include copper tetra (octadecyl sulfonamide) phthalocyanine, x-copper phthalocyanine pigment listed in the Color Index as CI74160, CI Pigment Blue, and Anthrathrene Blue identified in the Color Index as DI 69810, Special Blue X-2137, and the like or mixtures thereof Illustrative examples of yellows that may be selected include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,4-dimethoxy acetoacetanilide, and Permanent Yellow FGL. Colored magnetites, such as mixtures of MAPICOBLACK and cyan components may also be selected as pigments.

Coagulant

The coagulants used in the present process comprise poly metal halides, such as polyaluminum chloride (PAC) or polyaluminum sulfo silicate (PASS). For example, the coagulants provide a final toner having a metal content of, for example, about 400 to about 10,000 parts per hundred (pph), about 400 to about 4,000 pph, or about 600 to about 2,000 pph.

Particle Preparation

For example, emulsion/aggregation/coalescing processes for the preparation of toners are illustrated in a number of Xerox patents, the disclosures of each of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No.5,403,693, U.S. Pat. No. 5,418,108, U.S. Pat. No. 5,364,729, and U.S. Pat. No. 5,346,797. Also of interest are U.S. Pat. Nos. 5,348,832; 5,405,728; 5,366,841; 5,496,676; 5,527,658; 5,585,215; 5,650,255; 5,650,256; 5,501,935; 5,723,253; 5,744,520; 5,763,133; 5,766,818; 5,747,215; 5,827,633; 5,853,944; 5,804,349; 5,840,462; 5,869,215; 5,863,698; 5,902,710; 5,910,387; 5,916,725; 5,919,595; 5,925,488; and 5,977,210, the disclosures of each of which are totally incorporated herein by reference. In addition, Xerox patents U.S. Pat. Nos. 6,627,373; 6,656,657; 6,617,092; 6,638,677; 6,576,389; 6,664,017; 6,656,658; and 6,673,505 are each totally incorporated herein by reference. The appropriate components and process aspects of each of the foregoing may be selected for the present process in embodiments thereof.

For example, the colorant comprises in embodiments a pigment dispersion comprising pigment particles having a volume average diameter of about 50 nanometers to about 300 nanometers, water, and an anionic surfactant. More specifically a composite toner particle in is prepared by mixing a non cross linked resin with a cross linked resin or gel in the present of a wax and pigment dispersion to which is added a coagulant of a poly metal halide such as, for example, polyaluminum chloride, although not limited thereto, while blending at high speeds using a polytron. The resulting mixture having a pH of about 2.0 to about 3.0 is aggregated by heating to a temperature below the resin glass transition temperature (Tg) to provide a toner sized aggregate. Additional non cross linked latex is then added to the formed aggregates to provide a shell over the preformed aggregates. The pH of the mixture is then adjusted by the addition of a sodium hydroxide solution to achieve a pH of about 7.0. At a pH of about 7, the carboxylic acid becomes ionized providing additional negative charge on the aggregates thereby providing stability and preventing the particles from further growth or increase in grain size distribution (GSD) when heated above the Tg of the latex resin. The reactor mixture is heated at a temperature increase of about 1° C. per minute to achieve a temperature of about 95° C. At 95° C., the pH of the reactor mixture is adjusted to a pH of about 3.7 using a 0.3 M nitric acid solution. The reactor mixture is then gently stirred at 95° C. for about 5 hours to coalesce and spherodize the particles. The coalesced, spherodized particles are measured for shape factor, with a desired shape factor range comprising about 122 to about 128. The particle circularity can be measured, for example, using a Sysmex FPIA 2100 analyzer.

The mixture is allowed to cool to room temperature and washed as follows. A first wash is conducted at a pH of abut 10 and a temperature of about 63° C. followed by a deionized water (DIW) wash at room temperature. This is followed by a wash at a pH of about 4.0 and a temperature of about 40° C. followed by a final DIW wash. The toner is then dried.

EXAMPLES

Preparation of Non Cross Linked Resin

A latex emulsion comprising polymer particles generated form the emulsion polymerization of styrene, n-butyl acrylate, and beta-carboxy ethyl acrylate (beta-CEA) was prepared as follows. A surfactant solution comprising 0.8 grams Dowfax™ 2A1 alkyldiphenyloxide disulfonate anionic emulsifier and 514 grams of deionized water were prepared by mixing for 10 minutes in a stainless steel holding tank. The holding tank was then purged with nitrogen for 5 minutes before transferring into the reactor. The reactor was then continuously purged with nitrogen while being stirred at 300 RPM (revolutions per minute). The reactor was then heated to a temperature of 76° C. at a controlled rate, and then held at 76° C. Separately, 8.1 grams of ammonium persulfate initiator was dissolved in 45 grams of deionized water.

Separately, a monomer emulsion was prepared as follows. 413.2 grams of styrene, 126.8 grams of butyl acrylate, 16.2 grams of beta-CEA, 3.82 grams of 1-dodecanethiol, 1.89 grams of ADOD (1,10-decanediol diacrylate), 10.68 grams of Dowfax 2A anionic surfactant, and 256 grams of deionized water were mixed to form an emulsion. 1% of the above emulsion was then slowly fed into the reactor containing the aqueous surfactant phase at 76° C. to form the seeds while being purged with nitrogen. The initiator solution was then slowly charged into the reactor and after 10 minutes the rest of the emulsion was continuously fed using a metering pump at a rate of 0.5 milliliters per minute. After 100 minutes, half of the monomer emulsion has been added to the reactor. The monomer emulsion feed was paused and 4.5 grams of 1-dodecanethiol was added to the monomer emulsion. After 5 minutes, the monomer emulsion feed was continued into the reactor at a rate of 0. milliliters per minute, and the reactor stir rate was increased to 350 RPM. Once all of the monomer emulsion was charged into the main reactor, the temperature was held at 76° C. for an additional 2 hours to complete the reaction. Full cooling was then applied and the reactor temperature was reduced to 35° C. The product was collected into a holding tank. After drying, the resin molecular properties were Mw=35,419, Mn=11,354, and onset Tg (glass transition temperature)=51.0C.

Preparation of Cross Linked Resin or Gel

A latex emulsion comprising polymer gel particles generated from the semi-continuous polymerization of styrene, n-butyl acrylate, divinyl benzene, and beta-carboxy ethyl acrylate was prepared as a surfactant solution comprising 6 grams Neogen RK™ (sodium dodecylbenzene sulfonate) anionic emulsifier and 500 grams deionized water was prepared by mixing for 10 minutes in a stainless steel holding tank. The holding tank was then purged with nitrogen for 5 minutes before transferring into the reactor. The reactor was then continuously purged with nitrogen with stirring at 300 RPM. The reactor was then heated to a temperature of 76° C. at a controlled rate and held constant at 76° C. In a separate container, 4.25 grams of ammonium persulfate initiator was dissolved in 45 grams of deionized water.

In a separate container, the monomer emulsion was prepared in the following manner. 162.5 grams of styrene, 87.5 grams of n-butyl acrylate, 7.5 grams of beta-carboxy ethyl acrylate, and 2.5 grams of 55% grade divinylbenzene, 14 grams of Neogen RK™ (sodium dodecylbenzene sulfonate) anionic surfactant, and 270 grams of deionized water were mixed to form an emulsion. The ratio of styrene monomer to n-butyl acrylate monomer by weight was 65 percent styrene monomer to 35 percent n-butyl acrylate.

One percent of the above emulsion was then slowly fed into the reactor containing the aqueous surfactant phase at 76° C. to form the seeds while being purged with nitrogen. The initiator solution was then slowly charged into the reactor and after 20 minutes the rest of the emulsion was continuously fed into the reactor using a metering. Once all of the monomer emulsion was charged into the main reactor, the temperature was held at 76° C. for an additional 2 hours to complete the reaction. Full cooling was then applied and the reactor temperature was reduced to 35° C. The product was collected into a holding tank after filtration though a 1 micron filter bag. After drying a portion of the latex, the molecular properties were measured and determined to be Mw=134,700, Mn=27,300, and onset Tg=43.0° C. The average particle size of the latex was measured by Disc Centrifuge and determined to be 48 nanometers. The residual monomer was measured by gas chromatography and determined to be less than 50 ppm for styrene and less than 100 ppm for n-butyl acrylate.

Example

An example in accordance with the disclosure was prepared as follows. 191.4 grams of the above non cross linked resin having a solids loading of 41.4 weight % and 55.22 grams of polyethylene wax emulsion (Polywax 850®) having a solids loading of 30.07 weight % was added to 478.6 grams of deionized water in a vessel and stirred using an IKA Ultra Turrax® T50 homogenizer operating at 4,000 RPM (revolutions per minute). Thereafter, 113.512 grams of carbon black pigment dispersion from Sun Pigment WA 1945 (Regal® 330) having a solids loading of 17 weight %, 75 grams of cross linked resin or gel having a solids loading of 24 weight %, and 9.91 grams of a 1 weight % calcium chloride solution was added to the above mixture followed by drop-wise addition of 30.6 grams of a flocculent mixture containing 3.06 grams polyaluminum chloride mixture and 27.54 grams of 0.02 Molar (M) nitric acid solution. As the flocculent mixture was added drop-wise, the homogenizer speed was increased to 5,200 RPM and homogenized for an additional 5 minutes. Thereafter, the mixture was heated at 1° C. per minute to a temperature of 49° C. and held there for a period of about 1.5 to about 2 hours resulting in a volume average particle diameter of 5 microns as measured with a Coulter Counter. During the heat up period, the stirrer was run at about 250 RPM and 10 minutes after the set temperature of 49° C. was reached, the stirrer speed was reduced to about 220 RPM. An additional 124.6 grams of the above cross linked resin or gel was added to the reactor mixture and allowed to aggregate for an additional period of about 30 minutes at 49° C. resulting in a volume average particle diameter of about 5.7 microns. The reactor mixture was adjusted to a pH of 7 with a 1.0 M sodium hydroxide solution to freeze the particle size. Thereafter, the reaction mixture was heated at a rate of 1° C. per minute to a temperature of 95° C., followed by adjusting the reaction mixture to a pH of 3.7 with a 0.3 M nitric acid solution. Following this, the reaction mixture was gently stirred at 95° C. for 5 hours to enable the particles to coalesce and spherodize. The reactor heater was then turned off and the reaction mixture was allowed to cool to room temperature at a rate of one degree Celsius per minute. The resulting toner mixture comprised about 16.7 percent toner, 0.25 percent anionic surfactant, and about 82.9 percent water, weight basis. The toner of this mixture comprised about 71 percent styrene/acrylate polymer, about 10 weight percent of the above cross linked resin or gel, about 10 percent Regal® 330 black pigment, about 9 weight percent polyethylene (Polywax® PW850) wax, and about 150 ppm (parts per million)

calcium chloride. The toner had a volume average particle diameter of about 5.7 microns and a GSD (grain size distribution) of about 1.19. The particles were washed 6 times, the first wash being conducted at pH of about 10 at about 63° C., followed by 3 washes with deionizer water at room temperature, followed by one wash at a pH of about 4.0 at about 40° C., and a final wash with deionized water at room temperature.

Comparative Example

A Comparative Example was prepared as follows. 253.7 grams of the above non cross linked resin having a solids loading of 41.4 weight % and 54.80 grams of EAQax-51 polyethylene wax emulsion (Polywax® 725) having a solids loading of 30 weight % were added to 555.2 grams of deionized water in a vessel and stirred using an IKA Ultra Turrax T50® homogenizer operating at 4,000 RPM. Thereafter, 68.10 grams of black pigment dispersion (Sun Pigment WA 1945, Regal® 330) having a solids loading of 17 weight % was added to the above mixture followed by drop-wise addition of 21.6 grams of a flocculent mixture containing 2.16 grams polyaluminum chloride mixture and 1944 grams of a 0.02 molar nitric acid solution. As the flocculent mixture was added drop-wise, the homogenizer speed was increased to 5,200 RPM and homogenized for an additional 5 minutes. Thereafter, the mixture was heated at 1° C. per minute to a temperature of 49° C. and held at 49° C. for a period of about 1.5 to about 2 hours resulting in a volume average particle diameter of 5 microns as measured with a Coulter Counter. During the heat up period, the stirrer was run at about 250 RPM and 10 minutes after the set temperature of 49° C. was reached, the stirrer speed was reduced to about 220 RPM. An additional 124.6 grams of the above non cross linked resin was added to the reaction mixture and allowed to aggregate for an additional period of about 30 minutes at 49° C. resulting in a volume average particle diameter of about 5.7 microns. A 1.0 M sodium hydroxide solution was added to the reactor mixture to achieve a pH of 7 thereby freezing the particle size. Thereafter, the reactor mixture was heated at 1° C. per minute to a temperature of 95° C. and the pH of the reactor mixture was adjusted to 3.7 with a 0.3 M nitric acid solution. The reaction mixture was then gently stirred at 95° C. for 5 hours to enable the particles to coalesce and spherodize. The reactor heater was then turned off and the reaction mixture was allowed to cool to room temperature at a rate of one degree ° C. per minute. The resulting toner mixture was comprised of about 16.7% toner, 0.25% anionic surfactant, and about 82.9% water, weight basis. The toner of this mixture comprised about 85% styrene/acrylate polymer, about 6% Regal® 330 black pigment, about 9% by weight polyethylene (Polywax® PW725) wax, and had a volume average particle diameter of about 5.7 microns and a grain size distribution (GSD) of about 1.19. The particles were washed 6 times, with the first wash conducted at a pH of 10 at 63° C., followed by 3 washes with deionized water at room temperature, one wash carried out at a pH of 4.0 at 40° C. and finally a last wash with deionized water at room temperature.

Fusing Performance

Example toner particles were blended with 1.96% RY50 (Aerosil® fumed silica), 1.77% SMT5103 (SMT-5103 titania available from Tayca Corporation), 1.72% X24 (large silica available from Shin-Etsu), and 0.25% Zinc Stearate L (commercially available from Ferro Corp.). Unfused images were prepared using a DC265 Xerox Corporation printer and imaged onto Xerox 4024, 75 gsm paper. The images were produced at a 0.54 to 0.58 mg/cm$^2$ toner mass per unit area (TMA). The target image for gloss, crease and hot offset was a square, 6.35 cm by 6.35 cm or a rectangle, 6.35 cm by 3.8 cm, positioned near the center of the page.

Comparative Example toner particles were blended with 1.96% RY50 (Aerosil® fumed silica), 1.77% SMT5103 (SMT-5103 titania available from Tayca Corporation), 1.72% X24 (large silica available from Shin-Etsu), and 0.24% Zinc Stearate L (commercially available from Ferro Corp.). Unfused images were prepared using a DC265 Xerox Corporation printer and imaged onto Xerox 4024, 75 gsm paper. The images were produced at a 0.54 to 0.58 mg/cm$^2$ toner mass per unit area (TMA). The target image for gloss, crease and hot offset was a square, 6.35 cm by 6.35 cm or a rectangle, 6.35 cm by 3.8 cm, positioned near the center of the page.

Stripper finger marks were evaluated using a tree pattern having six trees across the sheet with three solid and three halftones.

The samples were fused offline with a Xerox XRCC PPID+ #17 Fusing Fixture supplied with a fresh TOS fuser roll and stripper fingers. A pressure roll and cleaning web having 100 Cs oil viscosity were supplied to the fixture and the fuser roll speed was set to 596 millimeters per second (mm/s). The fuser roll nip width was measured and determined to be 13.5+/−0.2 mm which gave a nip dwell time of 22.8 milliseconds (ms). The silicone oil rate was between 0.05 mg/copy to about 0.35 mg/copy. Nominal oil on copy in a machine running at 120 parts per minute (ppm) is about 0.05 mg/copy. One sheet at a time was sent through the fuser and oil on copy for the first few sheets was usually greater than the running oil rate. During fusing, the set point temperature of the fuser roll was varied from cold offset, about 150° C., to hot offset, or up to about 210° C. After the set point temperature was changed, the fuser roll and pressure roll were allowed to reach equilibrium by waiting ten minutes before the unfused samples were sent through the fuser. Oil on copy sheets were retained at various fusing temperatures.

The hot offset of the toner from print to fuser roll was measured by setting the fusser roll temperature to 210° C. and, if required, the fuser roll temperature was lowered until hot offset was no longer observed. Generally, the procedure includes the following steps. (1) The cleaning web was removed from the fuser roll and fifteen sheets of paper were run through the fuser to reduce the amount of oil on the roll. (2) The cleaning web was placed back into the fuser and run for 60 seconds. (3) The web was removed again, four sheets of paper, long edge feed, were sent through the fuser to reduce oil on the roll and an unfused sample was sent through the fuser followed by a blank tabloid sized (11 inches by 17 inches) sheet of paper. 4) The blank sheet was carefully examined for signs of toner.

1. Gloss

Print gloss (Gardner gloss units or "ggu") was measured using a 75° BYK Gardner gloss meter at a fuser roll temperature range of about 140° C. to about 210° C. Gloss readings were measured parallel and perpendicular to the process direction and the results were averaged (sample gloss is dependent on the toner, substrate and fuser roll). Print gloss properties at for the Example particles were about 9 to about 14 ggu. Print gloss for the Comparative Example particles were about 27 to about 21 ggu.

2. Document Offset

A standard document offset mapping procedure was performed as follows. Five centimeter (cm) by five cm test samples were cut from the prints taking care that when the sheets are placed face to face, providing toner to toner and toner to paper contact. A sandwich of toner to toner and toner to paper was placed on a clean glass plate. A glass slide was placed on the top of the samples and then a weight comprising a 2000 gram mass was placed on top of the glass slide. The weight was preheated in an oven to the same temperature as the environmental chamber; that is, about 60° C. The glass plate was then inserted into the environmental chamber where the relative humidity was kept constant at 50%. The temperature of the chamber was allowed to stabilize and the samples were stacked and loaded into the chamber. After 24 hours, the samples were removed from the chamber and allowed to cool to room temperature before the weight was removed. The removed samples were peeled apart by first placing the "bottom" sheet on a flat surface and then slowly peeling the top sheet at a 180° angle with a constant speed. The peeled samples were mounted onto a sample sheet and then visually rated for document offset using the Document Offset Grade Evaluation as set forth in Table 1.

TABLE 1

Document Offset Grade Evaluation

| Grade | Judgment Standard | Pass/Fail |
|---|---|---|
| 5 | No adhesion | Pass |
| 4.5 | Partial adhesion. Sticking sound. | Pass |
| 4 | Very little deficit. Toner adheres very little to white areas. | Pass |
| 3.5 | Little deficit. Toner adheres to white areas a little. | Pass |
| 3 | Deficit at under ⅓ area. Toner adheres to white area. | Pass |
| 2 | Deficit at under ⅓ to ½ area. Toner adheres to white area. | Fail |
| 1 | Deficit over ½ area. Toner adheres to white area. | Fail |
| 0 | Paper torn. | Fail |

Document offset performance for the Example and Comparative Example are shown in Table 2.

TABLE 2

Document Offset Performance

| Toner | Document Offset Toner/Toner | Document Offset Toner/Paper | Document Offset % Toner Toner/Paper |
|---|---|---|---|
| Comparative Example | 1.0 | 2 | 1.81 |
| Example | 2.0 | 3.5 | 0.07 |

While not wishing to be bound by theory, document offset performance is believed to be dependent upon the amount and type of wax used in the toner particles. Addition of cross linked resin or gel has been found to improve document offset performance. Increasing the amount of wax in the particles generally reduces the amount of offset damage. The Example and Comparative Example have the same amount of wax loading. However, the Example comprises polyethylene wax and the present cross linked resin or gel which is believed to increase document offset performance.

3. Vinyl Offset

Vinyl offset was evaluated by the method described above. Toner images in accordance with the Example and Comparative Example were covered with a piece of standard vinyl (32% dioctyl phthalate Plasticizer), placed between glass plates, loaded with a 250 gram weight, and placed in an environmental oven at a pressure of 10 g/cm$^2$, 50° C. and 50% RH for 24 hours. To ensure good contact to the non-compressible vinyl, only one sample sandwich was placed in each stack. Two replicates were prepared for each toner. The samples were cooled, carefully peeled apart, and evaluated with reference to a vinyl offset evaluation rating procedure as described above for document offset wherein Grades 5.0 to 1.0 indicate progressively higher amounts of toner offset onto the vinyl, from slight (5) to severe (1). Grade 5 indicates no toner offset onto vinyl and no disruption of the image gloss. Grade 4.5 indicates no toner offset, but some disruption of image gloss. An evaluation of greater than or equal to 4.0 is considered an acceptable grade.

Referring to Table 3, the Example and Comparative Example were ranked for vinyl offset using the Vinyl Offset Grade Evaluation and for percentage of toner transferred to the vinyl. The image analysis was performed by scanning in a flatbed scanner (Epson GT30000) the section of the vinyl that was placed against the vinyl with a plain white piece of paper as a backing sheet. The image of the vinyl was scanned into an image analysis program (Image Analysis software IMAQ from National Instruments IMAQ). The thresholding of the scanned image was adjusted so that the toner in the vinyl was detected but not the background paper or vinyl. The percent area (metric) is selected to determine the amount of toner over the scanned region (the pixel count of toner over the scanned area is measured and then divided by the total scanned area and then multiplied by 100). Ideally, no toner is detected, SIR (scanning image resolution)=4.5 (no toner transfer but a change in gloss of the print is found) to 5.0 (no toner transfer and no change in print gloss) or 0% area of toner on vinyl. On the other end of the measurement spectrum, all of the toner is transferred to the vinyl, SIR=1, or about 100% of the scanned area has toner.

TABLE 3

Vinyl Offset Performance

| Toner | Vinyl Offset | Vinyl Offset (Image Analysis %) |
|---|---|---|
| Comparative Example | 4 | 0.03 |
| Example | 2 | 8.67 |

4. Stripper Finger Marks

Stripper finger marks were evaluated For the Example and Comparative Example using a tree pattern comprising six trees across the sheet, three solid and three halftones. Only the two center solid trees were used for ranking damage. A Graphic Technology Inc. TRV-1 transmission/reflection booth, D5000 illumination was used to examine the marks. The stripper finger mark number corresponds to the width of a tree segment where damage first occurs on the pattern, with the higher number indicating the better score and a maximum possible contact area of 51 millimeters. For the two trees, the maximum combined score is 102. A stress case region is a rectangle at the bottom of the page such that maximum toner is contacted with the fuser roll. If damage is found on the square, it is noted but not recorded on the chart. Each tree is aligned so that a stripper finger rides over the tree starting from the narrow top across and down the trees. As the surface area of toner in contact with the fuser roll increases, the force necessary to peel the sheet from the roll also increases. A stress case image comprises a rectangle running the length of the sheet near the leading edge. If the force is large enough or the toner soft enough, the stripper finger will damage the image and a mark will become visible. When damage is severe enough, paper will be visible. Many factors determine whether or not stripper finger marks are observed (toner composition, TMA, wax type, wax loading, wax size and/or location, stripper finger design, oil on web, fuser roll speed, fuser roll temperature, etc.). At a fuser roll temperature range of about 150° C. to about 210° C., the sum of two stripper fingers for the Example was about 100 to about 100 (no damage) and for the Comparative Example the sum of two stripper fingers was about 25 to about 18 (severe damage).

5. Transmission Optical Density

It is desirable to achieve acceptable print density in combination with acceptable image mottle performance. An expert evaluation is used to determine when acceptable mottle is achieved and then related to an L* measurement and reflection Optical Density (O.D.) are dependent on image gloss and both saturate at higher densities. For engineering purposes, the transmission O.D. of a fused print is measured and related to when an acceptable image quality is reached. At the present time, acceptable image quality is reached with a transmission O.D. of 1.6, for example, depending on the substrate, image quality, among other factors.

Transmission optical density variation as a function of toner mass per unit area (mg/cm$^2$) on Xerox 4024 paper was measured for the Example and Comparative Example. Transmission optical density is measured with a Macbeth TR 927 reflection/transmission densitometer with the ortho setting selected. The paper optical density was subtracted from the measurement. The Example, comprising 10% carbon black pigment, had a TMA of 0.52 mg/cm$^2$ at a transmission optical density of 1.6. The comparative Example, comprising 6% carbon black pigment, required a TMA of 0.61 mg/cm$^2$ to meet the target of 1.6 transmission O.D. Reducing the amount of toner on the paper further provided a reduction in the total cost. The size of the toner particle also impacts the TMA required to achieve an acceptable transmission O.D. Smaller particles that are highly loaded with carbon black pigment are selected to meet low TMA targets.

Developer compositions can be prepared by mixing the toners obtained with the processes of the present disclosure with known carrier particles, including coated carriers, such as steel, ferrites, and the like, reference U.S. Pat. Nos. 4,937,166 and 4,935,326, the disclosures of which are totally incorporated herein by reference, using, for example from about 2 percent toner concentration to about 8 percent toner concentration. The carriers selected may also contain dispersed in the polymer coating a conductive compound, such as a conductive carbon black and which conductive compound is present in various suitable amounts, such as from about 15 to about 65, and preferably from about 20 to about 45, weight percent.

While the disclosure has been described by reference to certain preferred embodiments, it should be understood that numerous changes could be made within the spirit and scope of the inventive concepts described. Accordingly, it is intended that the disclosure not be limited to the disclosed embodiments, but that it have the full scope permitted by the language of the following claims.

The invention claimed is:

1. A toner composition comprising:

about 68% to about 75% of a resin substantially free of cross linking;

about 5% to about 10% of a cross linked resin;

about 6% to about 10% of a wax, wherein the wax polyethylene wax particles having a volume average particle diameter of about 100 to about 500 nanometers;

a coagulant providing a toner having a metal content of from about 400 to about 10,000 parts per hundred; and about 7% to about 13% of a colorant, wherein a total of the components is about 100%;

wherein the toner composition provides a fused image gloss of about 1 to about 20 gloss units;

a transmission optical density of greater than or equal to about 1.60 at a toner mass per unit area of about 0.52 mg/cm$^3$;

a document offset of about 3 to about 5;

a vinyl offset of about 4 to about 5; and essentially zero observable stripper finger mark damage under ambient office lighting conditions.

2. The toner composition of claim 1, possessing a fused image gloss of less than about 20 gloss units.

3. The toner composition of claim 1, possessing a fused image gloss of about 9 to about 14 gloss units.

4. A toner in accordance with claim 1, wherein the resin substantially free of cross linking is uncrosslinked and the colorant is carbon black.

5. The toner composition of claim 1, wherein the resin substantially free of cross linking and the cross linked resin are selected from the group consisting of styrene acrylates, styrene methacrylates, butadienes, isoprene, acrylonitrile, acrylic acid, methacrylic acid, beta-carboxy ethyl acrylate, polyesters, poly(styrene-butadiene), poly(methyl styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly (styrene-isoprene), poly(methyl styrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butyl acrylate-acrylic acid), poly(styrene-butyl acrylate-methacrylic acid), poly(styrene-butyl acrylate-acrylonitrile), poly(styrene-butyl acrylate-acrylonitrile-acrylic acid), and styrene/butyl acrylate/carboxylic acid terpolymers, or mixtures thereof.

6. The toner composition of claim 1, wherein the resin substantially free of cross linking comprises styrene:butylacrylate:beta-carboxy ethyl acrylate and wherein the cross linked resin comprises styrene:butylacrylate:beta-carboxy ethyl acrylate:divinyl benzene.

7. The toner composition of claim 1, possessing a metal content in an amount of about 400 to about 4000 parts per hundred.

8. The toner composition of claim 1, possessing an aluminum content in an amount of about 600 to about 2,000 parts per hundred.

9. The toner composition of claim 1, wherein the wax is in the form of a dispersion comprising a wax having a volume average particle diameter of about 100 to about 500 nanometers, water, and an anionic surfactant.

10. The toner composition of claim 1, wherein the colorant comprises a pigment, a dye, carbon black, magnetite, black, cyan, magenta, yellow, red, green, blue, brown, or mixtures thereof, in an amount of about 1% to about 25% by weight based upon the total weight of the composition.

11. The toner of claim 1, wherein the colorant comprises a pigment dispersion comprising pigment particles having a volume average diameter of about 50 to about 300 nanometers, water, and an anionic surfactant.

12. A developer comprising the composition of claim 1; and a carrier.

13. A xerographic device comprising a charging component, an imaging component, a photoconductive component, a developing component, a transfer component, and a fusing component, and wherein the development component comprises a developer comprising the composition of claim 1 and a carrier.

14. The device of claim 13, wherein the device for preparing an image comprises a high speed printer, a black and white high speed printer, a color printer, or combinations thereof.

15. The toner composition of claim 1, comprising about 71% resin substantially free of cross linking, about 10% cross linked resin, about 9% wax, and about 10% colorant comprising black pigment, by weight based upon the total weight of the composition and wherein a total of the components is about 100%.

16. The toner composition of claim 15, wherein the wax comprises a brand of industrial polyethylene wax and the colorant comprises black pigment.

17. A developer comprising the composition of claim 15; and a carrier.

18. The toner composition of claim 1, wherein the colorant is black.

* * * * *